US008876559B2

(12) United States Patent
Wu

(10) Patent No.: US 8,876,559 B2
(45) Date of Patent: Nov. 4, 2014

(54) ELECTRONIC DEVICE AND SWITCH METHOD THEREOF

(75) Inventor: Tai-Lin Wu, New Tapei (TW)

(73) Assignee: Quanta Computer Inc., Taoyuan Shien (TW)

( * ) Notice: Subject to any disclaimer, the term of this patent is extended or adjusted under 35 U.S.C. 154(b) by 277 days.

(21) Appl. No.: 13/454,485

(22) Filed: Apr. 24, 2012

(65) Prior Publication Data

US 2013/0196543 A1 Aug. 1, 2013

(30) Foreign Application Priority Data

Jan. 30, 2012 (TW) ..... 101102917 A

(51) Int. Cl.
*H01R 24/58* (2011.01)
*H01R 105/00* (2006.01)

(52) U.S. Cl.
CPC ..... *H01R 24/58* (2013.01); *H01R 2105/00* (2013.01); *Y10S 439/955* (2013.01)
USPC ..... 439/669; 439/955

(58) Field of Classification Search
USPC ..... 439/668, 669, 955
See application file for complete search history.

(56) References Cited

U.S. PATENT DOCUMENTS

| | | | | |
|---|---|---|---|---|
| 6,069,960 | A * | 5/2000 | Mizukami et al. | 381/74 |
| 6,988,905 | B2 * | 1/2006 | Corey et al. | 439/222 |
| 8,449,318 | B2 * | 5/2013 | Beller et al. | 439/489 |
| 8,467,828 | B2 * | 6/2013 | Johnson et al. | 455/556.1 |
| 2011/0045680 | A1 * | 2/2011 | Beller et al. | 439/188 |
| 2012/0142225 | A1 * | 6/2012 | Hansson et al. | 439/669 |
| 2014/0017955 | A1 * | 1/2014 | Lo et al. | 439/668 |

* cited by examiner

*Primary Examiner* — Neil Abrams
*Assistant Examiner* — Travis Chambers
(74) *Attorney, Agent, or Firm* — Rabin & Berdo, P.C.

(57) ABSTRACT

An electronic device including a switch unit and a socket is provided. The switch unit has an output end, a first input end, a second input end and a control end. The control end is coupled to the first input end. The socket has an intake cavity on which a first terminal and a second terminal are disposed. The first terminal is electrically connected to the first input end, and the second terminal is electrically connected to the second input end. When the intake cavity holds a plug and the control end receives a high level voltage, the control end switches the first input end to the output end. When the control end receives a ground voltage, the control end switches the second input end to the output end.

4 Claims, 1 Drawing Sheet

ELECTRONIC DEVICE AND SWITCH METHOD THEREOF

This application claims the benefit of Taiwan application Serial No. 101102917, filed Jan. 30, 2012, the subject matter of which is incorporated herein by reference.

BACKGROUND OF THE INVENTION

1. Field of the Invention

The disclosure relates in general to an electronic device and a switch method thereof.

2. Description of the Related Art

Currently, there are two types of headphone/microphone plug available in the market, one is Apple side plug defined by the Apple Inc., while the other is non-Apple side plug defined by the Nokia Corporation. The two types of plugs have different order in the disposition of contact electrodes. Since ordinary 3C products only support one type of headphone/microphone plug, the user may easily get confused and buy the wrong one.

SUMMARY OF THE INVENTION

The disclosure is directed to an electronic device and a switch method thereof which achieve the function of automatic switching with simple circuits.

According to a first aspect of the present disclosure, an electronic device including a switch unit and a socket is provided. The switch unit has an output end, a first input end, a second input end and a control end. The control end is coupled to the first input end. The socket has an intake cavity on which a first terminal and a second terminal are disposed. The first terminal is electrically connected to the first input end, and the second terminal is electrically connected to the second input end. When the intake cavity holds a plug and the control end receives a high level voltage, the control end switches the first input end to the output end. When the control end receives a ground voltage, the control end switches the second input end to the output end According to a second aspect of the present disclosure, a switch method used in an electronic device is provided. The electronic device includes a switch unit and a socket. The switch unit has an output end, a first input end, a second input end and a control end. The control end is coupled to the first input end. The socket has an intake cavity on which a first terminal and a second terminal are disposed. The first terminal is electrically connected to the first input end, and the second terminal is electrically connected to the second input end. The electronic device switch method includes the following steps. When the intake cavity holds a plug and the control end receives a high level voltage, the control end switches the first input end to the output end. When the control end receives a ground voltage, the control end switches the second input end to the output end.

The above and other aspects of the disclosure will become better understood with regard to the following detailed description of the preferred but non-limiting embodiment(s). The following description is made with reference to the accompanying drawings.

DETAILED DESCRIPTION OF THE INVENTION

The electronic device and the switch method thereof of the disclosure achieve the function of automatic switching with simple circuits, such that the electronic device may support different types of headphone/microphone plugs.

Figure 1:
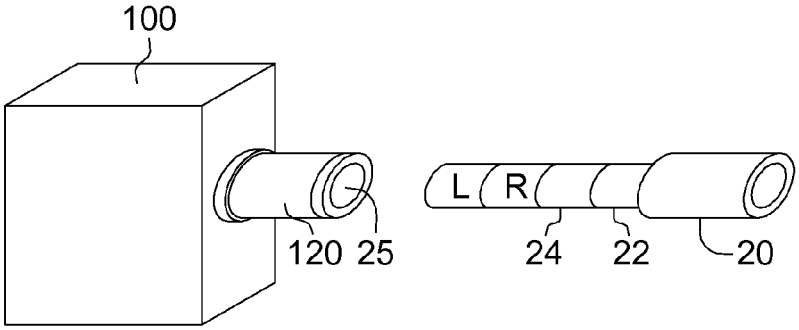
FIG. 1 shows a structure diagram of an electronic device according to an embodiment.
Figure 2:
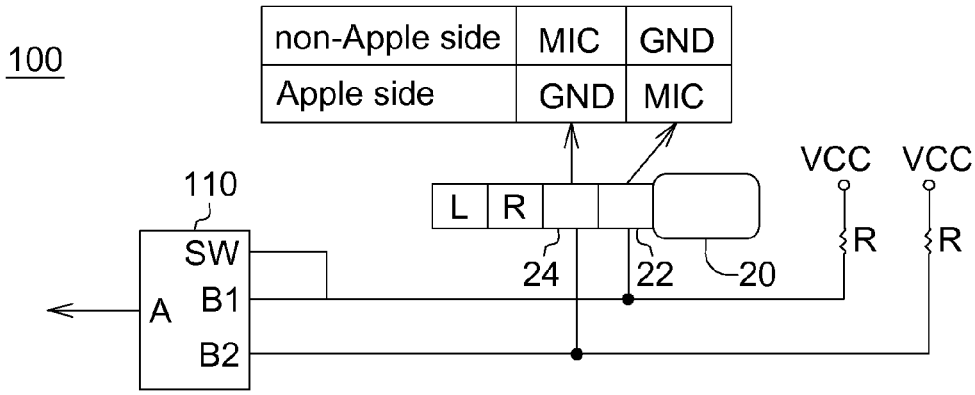
FIG. 2 shows a circuit diagram of an electronic device according to an embodiment.

Referring to FIG. 1 and FIG. 2. FIG. 1 shows a structure diagram of an electronic device according to an embodiment. FIG. 2 shows a circuit diagram of an electronic device according to an embodiment. The electronic device 100 includes a switch unit 110 and a socket 120. The switch unit 110 has an output end A, a first input end B1, a second input end B2 and a control end SW. The control end SW is coupled to the first input end B1. The control end SW controls one of the first input end B1 and the second input end B2 to be outputted to the output end A.

In the present embodiment, the switch unit 110 switches the output end A between the first input end B1 and the second input end B2 according to Table 1. If the voltage received at the control end SW is a high level voltage (such as a working voltage VCC), then the output end A is switched to the first input end B1. If the voltage received at the control end SW is a low level voltage (such as a ground voltage GND), then the output end A is switched to the second input end B2. In a practical embodiment without any plug being inserted into the socket 120, the first input end B1, the second input end B2 and the control end SW are connected to a high level voltage (such as a working voltage VCC) from the electronic device 100. In a practical embodiment, the switch unit 110 is realized by a chip.

TABLE 1

| | Voltage Received at Control End SW | |
|---|---|---|
| | High (VCC) | Low (GND) |
| Output End A | First Input End B1 | Second Input End B2 |

However, the disclosure is not for restricting the switch unit 110 to perform switching according to Table 1 only. The switch unit 110 may perform switching according to circuit connection. For example, if the voltage received at the control end SW is a high level voltage (such as a working voltage VCC), then the output end A is switched to the second input end B2. If the voltage received at the control end SW is a low level voltage (such as a ground voltage GND), then the output end A is switched to the first input end B1. In a practical embodiment without any plug being inserted into the socket 120, the first input end B1, the second input end B2 and the control end SW are all connected to a low level voltage (such as a ground voltage GND).

The socket 120 is an audio jack having an intake cavity 25 on which a first terminal and a second terminal are disposed. The first terminal is electrically connected to the first input end B1. The second terminal is electrically connected to the second input end B2. The socket 120 further has a left audio frequency terminal and a right audio frequency terminal. The terminals disposed on the inner side of the intake cavity 25 are not illustrated in the diagram.

The intake cavity 25 holds a headphone/microphone plug 20. The plug 20 has a microphone contact electrode, a ground contact electrode, a right audio frequency contact electrode R and a left audio frequency contact electrode L. If the plug 20 is an Apple side plug, then the contact electrode 22 is defined as a microphone contact electrode MIC, and the contact electrode 24 is defined as a ground contact electrode GND. Conversely, if the plug 20 is a non-Apple side plug, then the contact electrode 22 is defined as a ground contact electrode GND, and the contact electrode 24 is defined as a microphone contact electrode MIC.

When the plug 20 is an Apple side plug and is held in the intake cavity 25, the contact electrode 22 electrically contacted by the first terminal of the socket 120 is a microphone contact electrode MIC, and the contact electrode 24 electrically contacted by the second terminal is a ground contact electrode GND, the right audio frequency terminal electrically contacts the right audio frequency contact electrode R, and the left audio frequency terminal electrically contacts the left audio frequency contact electrode L. That is, the first input end B1 is electrically connected to the microphone contact electrode MIC (22), and the second input end B2 is electrically connected to the ground contact electrode GND (24). As descripted previously, the high level voltage (such as a working voltage VCC) has originally been inputted to the first input end B1 and the second input end B2. When the Apple side plug is held in the intake cavity 25, the first input end B1 still receives a high level voltage and make the control end SW coupled to the first input end B1 also maintain a high level voltage. According to Table 1, the output end A is switched to the first input end B1. That is, the output end A outputs the signal of the microphone contact electrode MIC (22) to avoid erroneously outputting the signal of the ground contact electrode GND (24). Then, the output end A may output the microphone signal of the Apple side plug to a codec at the rear end of the electronic device 100 for transcoding (encoding/decoding).

Likewise, when the plug 20 is an non-Apple side plug and is held in the intake cavity 25, the contact electrode 22 electrically contacted by the first terminal of the socket 120 is a ground contact electrode GND, and the contact electrode 24 electrically contacted by the second terminal is a microphone contact electrode MIC, the right audio frequency terminal electrically contacts the right audio frequency contact electrode R, and the left audio frequency terminal electrically contacts the left audio frequency contact electrode L. That is, the first input end B1 is electrically connected to the ground contact electrode GND, and the second input end B2 is electrically connected to the microphone contact electrode MIC. As descripted previously, the high level voltage (such as a working voltage VCC) has originally been inputted to the first input end B1 and the second input end B2. When the non-Apple side plug is held in the intake cavity 25, the first input end B1, having contacted the ground contact electrode GND (22), receives a ground voltage (pull-low) and make the control end SW coupled to the first input end B1 receive the ground voltage. According to Table 1, the switch unit 110 switches the second input end B2 to the output end A. That is, the output end A outputs the signal of the microphone contact electrode MIC (24) to avoid erroneously outputting the signal of the ground contact electrode GND (22). Then, the output end A outputs the microphone signal (24) of the non-Apple side plug to a codec at the rear end of the electronic device 100 for transcoding (encoding/decoding).

The disclosure further provides an electronic device switch method. The electronic device includes a switch unit and a socket. The switch unit has an output end, a first input end, a second input end and a control end. The control end is coupled to the first input end. The socket has an intake cavity on which a first terminal and a second terminal are disposed. The first terminal is electrically connected to the first input end, and the second terminal is electrically connected to the second input end. The electronic device switch method includes the following steps. A high level voltage is outputted to the first input end and the second input end. A plug is held in the intake cavity. When the control end receives the high level voltage, the first input end is switched to the output end by the control end. When the control end receives a ground voltage, the second input end is switched to the output end by the control end.

The principles of operation of the electronic device switch method are already disclosed in the descriptions of the electronic device 100 and associated disclosure, and are not repeated here.

The electronic device and the switch method thereof disclosed in above embodiments of the disclosure achieve the function of automatic switching with simple circuits, such that the electronic device may support both the Apple side and the non-Apple side headphone/microphone plugs, and the convenience of use is largely increased.

While the disclosure has been described by way of example and in terms of the preferred embodiment (s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electronic device, comprising:

a switch unit having an output end, a first input end, a second input end and a control end, wherein the control end is coupled to the first input end;

a socket having an intake cavity on which a first terminal and a second terminal are disposed, wherein the first terminal is electrically connected to the first input end, and the second terminal is electrically connected to the second input end;

wherein, a high level voltage is outputted to the first input end and the second input end and when the intake cavity holds a plug and the control end receives the high level voltage, the control end switches the first input end to the output end; when the control end receives a ground voltage, the control end switches the second input end to the output end; and wherein the electronic device further comprising a codec electrically connected to the output end to transcode a microphone signal outputted from the plug.

2. The electronic device according to claim 1, wherein the plug has a microphone contact electrode and a ground contact electrode, the first terminal electrically contacts the microphone contact electrode, and the second terminal electrically contacts the ground contact electrode.

3. The electronic device according to claim 1, wherein the plug has a microphone contact electrode and a ground contact electrode, the first terminal electrically contacts the ground contact electrode, and the second terminal electrically contacts the microphone contact electrode.

4. A switch method used in an electronic device, wherein the electronic device comprises a switch unit and a socket, the switch unit has an output end, a first input end, a second input end and a control end, the control end is coupled to the first input end, the socket has an intake cavity on which a first terminal and a second terminal are disposed, the first terminal is electrically connected to the first input end, the second terminal is electrically connected to the second input end, a high level voltage is outputted to the first input end and the second input end, wherein the electronic device further comprises a codec electrically connected to the output end, and the electronic device switch method comprises:

holding a plug in the intake cavity;

switching the first input end to the output end by the control end when the control end receives the high level voltage;

switching the second input end to the output end by the control end when the control end receives a ground voltage; and transcoding, by the codec, a microphone signal outputted from the plug.

* * * * *